US010488021B2

(12) United States Patent
Panyik et al.

(10) Patent No.: US 10,488,021 B2
(45) Date of Patent: Nov. 26, 2019

(54) LIGHTING SYSTEM WITH MODULAR HEAT MANAGEMENT APPARATUS

(71) Applicant: GE Lighting Solutions, LLC, East Cleveland, OH (US)

(72) Inventors: Tamas Panyik, Budapest (HU); Zoltan Janki, Budapest (HU); Balazs Nagy, Budapest (HU)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 15/538,878

(22) PCT Filed: Dec. 22, 2015

(86) PCT No.: PCT/US2015/067388
§ 371 (c)(1),
(2) Date: Jun. 22, 2017

(87) PCT Pub. No.: WO2016/106322
PCT Pub. Date: Jun. 30, 2016

(65) Prior Publication Data

US 2017/0370557 A1 Dec. 28, 2017

Related U.S. Application Data

(63) Continuation of application No. 14/578,633, filed on Dec. 22, 2014, now abandoned.

(51) Int. Cl.
*F21V 29/70* (2015.01)
*F21V 17/00* (2006.01)
(Continued)

(52) U.S. Cl.
CPC ..... *F21V 17/002* (2013.01); *F21V 17/10* (2013.01); *F21V 17/12* (2013.01); *F21V 29/503* (2015.01);
(Continued)

(58) Field of Classification Search
CPC ..... F21V 29/74; F21V 29/70; F21V 29/503; F21V 29/004
(Continued)

(56) References Cited

U.S. PATENT DOCUMENTS 5,357,404 A * 10/1994 Bright ..... H01L 23/4093 174/381
5,594,624 A * 1/1997 Clemens ..... H01L 23/4093 174/16.3
(Continued)

FOREIGN PATENT DOCUMENTS

AU 2008200850 A1 9/2009
CN 2437097 Y 6/2001
(Continued)

OTHER PUBLICATIONS

International Search Report and Written Opinion issued in connection with corresponding PCT application PCT/US2015/067388 dated Apr. 26, 2016.
(Continued)

*Primary Examiner* — Ismael Negron
(74) *Attorney, Agent, or Firm* — Buckley, Maschoff & Talwalkar, LLC

(57) ABSTRACT

A lighting system including a plurality of lighting elements; a housing with a top surface having an interface portion and an inner surface portion supporting the lighting element; a heat sink mounted onto the interface portion and configured
(Continued)

to dissipate heat generated by the lighting elements; and a fixing element configured to secure the heat sink to the interface portion.

21 Claims, 6 Drawing Sheets

(51) Int. Cl.

| | |
|---|---|
| ***F21V 17/10*** | (2006.01) |
| ***F21V 29/503*** | (2015.01) |
| ***F21V 29/507*** | (2015.01) |
| ***F21V 29/89*** | (2015.01) |
| ***F21V 29/71*** | (2015.01) |
| ***F21V 17/12*** | (2006.01) |
| *F21W 131/103* | (2006.01) |
| *F21Y 115/10* | (2016.01) |
| *F21Y 101/00* | (2016.01) |

(52) U.S. Cl.
CPC ..... *F21V 29/507* (2015.01); *F21V 29/713* (2015.01); *F21V 29/89* (2015.01); *F21W 2131/103* (2013.01); *F21Y 2101/00* (2013.01); *F21Y 2115/10* (2016.08)

(58) Field of Classification Search
USPC ..... 362/294
See application file for complete search history.

(56) References Cited

U.S. PATENT DOCUMENTS

| | | | | | |
|---|---|---|---|---|---|
| 5,600,540 | A * | 2/1997 | Blomquist | H01L 23/4093 | 174/16.3 |
| 5,804,875 | A * | 9/1998 | Remsburg | H01L 23/4093 | 174/16.3 |
| 5,969,950 | A * | 10/1999 | Tantoush | H01L 23/4006 | 165/80.3 |
| 6,071,128 | A * | 6/2000 | Brewington | H01L 23/4093 | 257/E23.086 |
| 6,205,026 | B1 * | 3/2001 | Wong | H01L 23/4093 | 165/80.3 |
| 6,222,734 | B1 * | 4/2001 | Bookhardt | H01L 23/4093 | 24/458 |
| 6,507,981 | B1 * | 1/2003 | Bosak, III | H01L 23/4006 | 165/80.3 |
| 6,519,153 | B1 * | 2/2003 | Shia | H01L 23/36 | 165/185 |
| 6,639,800 | B1 * | 10/2003 | Eyman | H01L 23/4006 | 165/185 |
| 7,333,333 | B2 * | 2/2008 | Zhao | H01L 23/4093 | 165/185 |
| 7,588,355 | B1 * | 9/2009 | Liu | F21S 2/005 | 362/240 |
| 7,639,501 | B2 * | 12/2009 | Wang | H01L 23/4093 | 165/80.3 |
| 7,682,055 | B2 * | 3/2010 | Shuai | F21V 29/004 | 362/373 |
| 7,722,222 | B2 * | 5/2010 | Zheng | F21V 29/004 | 165/104.33 |
| 7,746,651 | B2 * | 6/2010 | Yu | H01L 23/4093 | 165/185 |
| 7,753,556 | B1 * | 7/2010 | Zhang | F21S 8/06 | 362/249.02 |
| 7,787,251 | B2 * | 8/2010 | Bailey | H01L 23/4093 | 165/185 |
| 7,794,116 | B2 * | 9/2010 | Shuai | F21V 29/004 | 362/249.02 |
| 7,832,892 | B2 * | 11/2010 | Xiao | F21S 8/086 | 362/145 |
| 7,994,533 | B2 * | 8/2011 | Xiao | F21V 29/004 | 257/99 |
| 9,383,090 | B2 * | 7/2016 | Scarlata | F21V 29/507 | |
| 2006/0250803 | A1 * | 11/2006 | Chen | F21S 8/086 | 362/373 |
| 2007/0070628 | A1 | 3/2007 | Chen | | |
| 2008/0043479 | A1 * | 2/2008 | Wang | F21V 29/004 | 362/373 |

FOREIGN PATENT DOCUMENTS

| | | | |
|---|---|---|---|
| CN | 103047623 | A | 4/2013 |
| CN | 102759045 | B | 8/2014 |
| EP | 2 535 642 | A2 | 12/2012 |
| EP | 2535642 | A2 | 12/2012 |
| KR | 10-1032349 | B1 | 5/2011 |
| KR | 101032349 | B1 | 5/2011 |

OTHER PUBLICATIONS

J.J. Salgon et al: "A mechanical and geometrical approach to thermal contact resistance", International Journal of Heat and Mass Transfer., vol. 40, No. 5, Mar. 1, 1997 pp. 1121-1129, XP055252208 (Mar. 1, 1997), ISSN: 0017-9310, DOI: 10.1016/0017-9310(96)00130-5 p. 1125.

Yup Shlykov et al: "Thermal resistance of metallic contacts", International Journal of Heat and Mass Transfer.,vol. 7, No. 8, Aug. 1, 1964 (Aug. 1, 1964), pp. 921-929, XP055252206, ISSN: 0017-9310, DOI: 10.1016/0017-9310(64)90147-4 pp. 926-928.

Salgon, J. J., et al., "A mechanical and geometrical approach to thermal contact resistance," International Journal of Heat and Mass Transfer, vol. 40, Issue 5, (1997), PII: S0017-9310(96)00130-5, (pp. 1121-1129, 9 total pages).

Shlykov, Yu. P., and Ganin, Y. A.,"Thermal Resistance of Metallic Contacts," International Journal of Heat and Mass Transfer, vol. 7, (1964), (pp. 921-929, 9 total pages).

First Office Action and Search issued in connection with corresponding CN Application No. 201580070404.0 dated Jan. 2, 2019, 15pgs.

Office Action issued in connection with corresponding EP Application No. 15826255.0 dated Jul. 19, 2018.

* cited by examiner

LIGHTING SYSTEM WITH MODULAR HEAT MANAGEMENT APPARATUS

FIELD

The technical field relates generally to an outdoor lighting system (e.g., an outdoor luminaire). In particularly, a modular heat management apparatus of the outdoor lighting system which has thermal scaleability capabilities for managing heat dissipation of the outdoor lighting system regardless of amount of power to be supplied to the lighting system.

BACKGROUND

Heat management plays an important role in an outdoor lighting system. The outdoor lighting system may employ high-flux lighting elements (e.g., LEDs) and the temperature of the lighting elements can affect the luminaire efficacy and performance, and therefore maintaining a low temperature at a junction of the lighting elements and the housing of the outdoor lighting system is critical.

In a current example, LED-based roadway outdoor lighting systems have a same housing for a total range of system power, and the thermal condition varies based on the actual system power. Thus, these types of lighting systems are designed thermally for high system power. Therefore, in low system power cases, the housing provides unnecessary cooling and increased costs compared to use of a smaller housing.

SUMMARY OF THE EMBODIMENTS

The various embodiments of the present disclosure are configured to provide a modular extendable heat management apparatus of an outdoor lighting system, having thermal scaleability capabilities.

In one exemplary embodiment, a modular heat management apparatus for an outdoor lighting system is provided which comprises a housing comprising an interface portion disposed at a top surface of the housing, an attachable heat sink to be disposed and mounted onto the interface portion and configured to dissipate heat generated by the outdoor lighting system, and a fixing element configured to attach the heat sink to the interface portion and to apply contact pressure thereto.

In another exemplary embodiment, a modular heat management apparatus is provided which comprises a housing, the housing comprising an interface portion disposed at a top surface of the housing, an attachable heat sink to be disposed on the interface portion and configured to dissipate heat generated by the outdoor lighting system, the attachable heat sink having a receiving portion for receiving a fixing element, and at least one fixing element configured to be disposed within the receiving portion, to attach the attachable heat sink to the interface portion, and to apply contact pressure thereto.

The foregoing has broadly outlined some of the aspects and features of various embodiments, which should be construed to be merely illustrative of various potential applications of the disclosure. Other beneficial results can be obtained by applying the disclosed information in a different manner or by combining various aspects of the disclosed embodiments. Accordingly, other aspects and a more comprehensive understanding may be obtained by referring to the detailed description of the exemplary embodiments taken in conjunction with the accompanying drawings, in addition to the scope defined by the claims.

Figure 1:
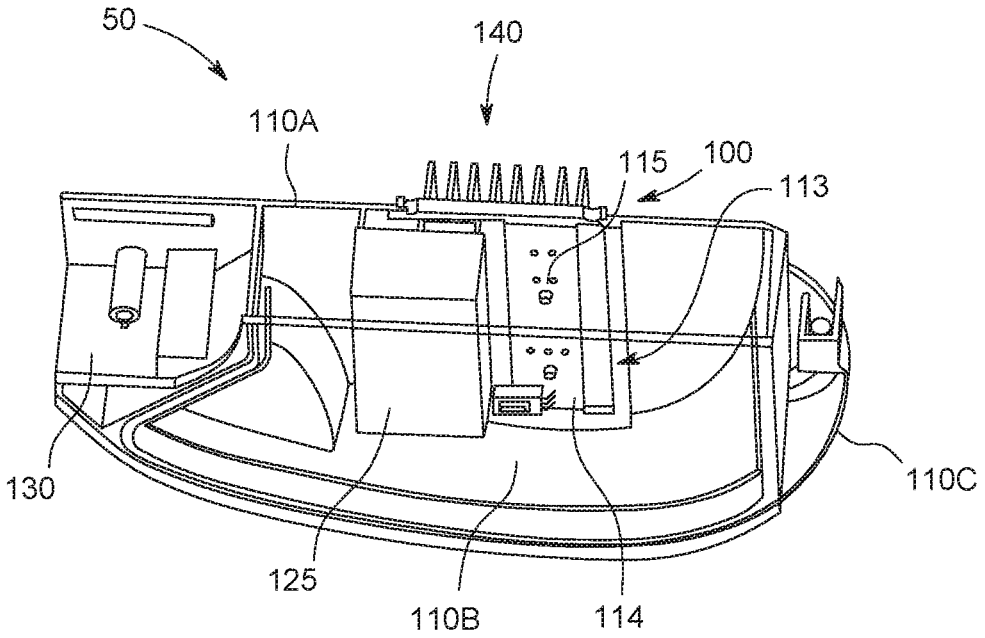
FIG. 1 is a schematic of an outdoor lighting system according to one or more exemplary embodiments.

The drawings are only for purposes of illustrating preferred embodiments and are not to be construed as limiting the disclosure. Given the following enabling description of the drawings, the novel aspects of the present disclosure should become evident to a person of ordinary skill in the art. This detailed description uses numerical and letter designations to refer to features in the drawings. Like or similar designations in the drawings and description have been used to refer to like or similar parts of embodiments of the invention.

DETAILED DESCRIPTION OF THE EMBODIMENTS

As required, detailed embodiments are disclosed herein. It must be understood that the disclosed embodiments are merely exemplary of various and alternative forms. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

Exemplary embodiments of the present invention provide a modular heat management apparatus for an outdoor lighting system, the apparatus comprising a housing comprising an interface portion disposed at a top region of the housing, an attachable heat sink to be disposed on the interface portion, and a fixing element configured to attach the heat sink to the interface portion.

FIG. 1 is a schematic illustration of an outdoor lighting system 50, according to one or more exemplary embodiments. The outdoor lighting system 50 includes a modular heat management apparatus 100 which includes a housing 110 having a top surface 110*a*, an inner region 110*b* and a bottom surface 110*c*, the housing 110 comprising a light engine 113 having a printed circuit board (PCB) 114 including a plurality of lighting elements 115 (e.g., lighting emitting diodes (LEDs) and other electrical circuitry mounted thereon, an power supply (not shown) for supplying power to the outdoor lighting system 50 and a lighting driver 125 connected with the PCB 114 and configured to receive power from the power supply and supply power to the light engine 113 for operation of the plurality of lighting elements 115. The housing 110 may comprise cooling ribs (not shown) formed at an inner top surface of the housing 110 to allow for cooling within the housing 110 based on the heat generated from the components (e.g., the lighting driver 125) therein. A reflector (not shown) may also be provided for reflecting the light emitted from the lighting elements 115 in a desired direction away from the lighting system 50. A gear tray (not shown) may also be provided for housing control switches (e.g., on/off or dimming switches) for controlling an operation state of the indoor lighting system 50. A coupler 130 is also provided for connecting the lighting system 50 to a support surface. An attachable heat sink 140 is also provided and configured to dissipate heat generated from lighting elements 115 of the outdoor lighting system 50. Details of the heat dissipation of the modular heat management apparatus 100 will be discussed below with reference to FIGS. 2 through 10.

Figure 2:
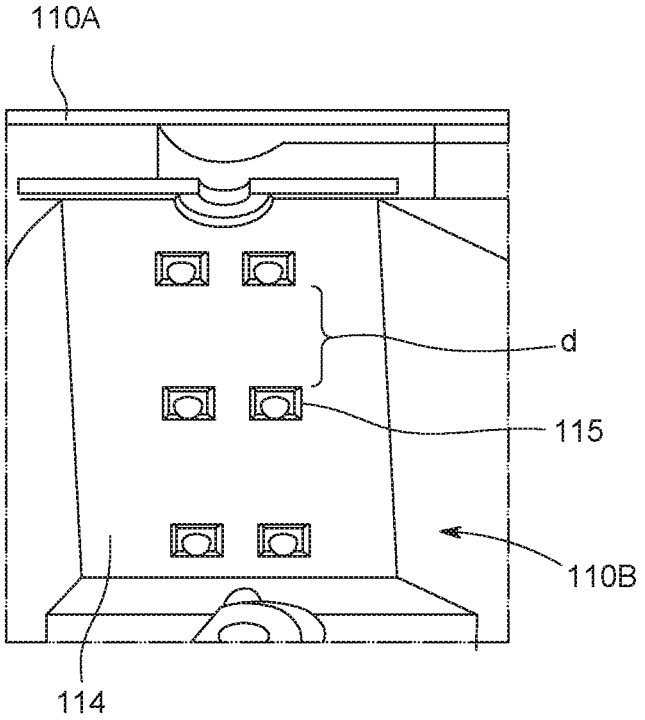
FIG. 2 is an expanded view of the lighting elements shown in FIG. 1 according to one or more exemplary embodiments.

FIG. 2 is an expanded view of the lighting elements shown in FIG. 1 according to one or more exemplary embodiments. As shown in FIG. 2, the PCB 114 having the lighting elements 115 mounted thereon, are disposed at a top inner surface of the inner region 110*b* adjacent to the top surface 110*a* of the modular heat management apparatus 100 and the lighting elements 115 are spaced apart from each other a predetermined distance "d". The present invention is not limited to any particular number of lighting elements 115 or a particular arrangement thereof, and therefore may vary as desired. The lighting elements 115 may be positioned such that light emitted therefrom is emitted in a downward direction. Further, the lighting elements 115 are positioned at an end opposite an end coupled via the coupler 130 with the surface having the modular heat management apparatus 100 mounted thereon.

Figure 3:
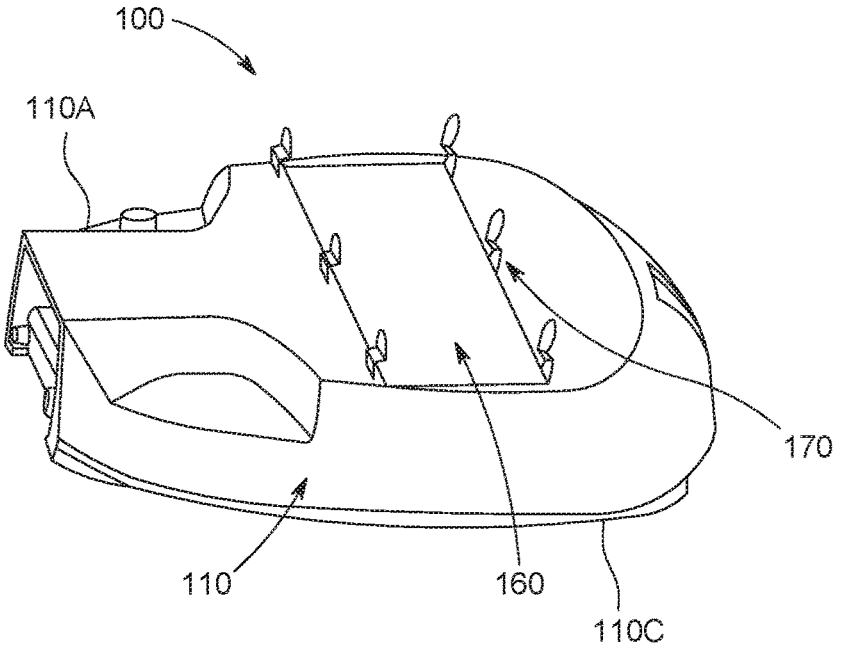
FIG. 3 is schematic illustration of a modular heat management apparatus for the outdoor lighting system according to one or more exemplary embodiments.

FIG. 3 is a schematic illustration of the modular heat management apparatus 100 according to one or more exemplary embodiments. As shown in FIG. 3, the modular heat management apparatus 100 includes the top surface 110*a* of the housing 110 comprising an interface portion 160 for receiving the attachable heat sink 140, (as depicted in FIG. 1) thereon, and a fixing element 170 for fixing the attachable heat sink 140.

The housing 110 is configured to other components in the inner region 110*b* thereof, as shown in FIG. 1, for operation of the outdoor lighting system 50. The housing 110 may be formed of any shape or size as suitable for the purposes set forth herein.

According to one or more exemplary embodiments, the housing 110 may be formed of a low thermal conductive material including for example, plastic, titanium, or iron. The thermal conductivity of the material may be approximately 0.5 W/m-K. The housing 110 is configured for mechanically fixing the components of the outdoor lighting system 50. According to alternative embodiments, the housing 110 may be formed of a high thermal conductive material including for example, aluminum.

The interface portion 160 is disposed at a top surface 110*a* of the housing 110 opposite the bottom surface 110*c*. The interface portion 160 is formed of a thermally conductive material higher in thermal conductivity than that of the housing 110. According to one or more exemplary embodiments, the housing 110 may be formed of a low thermal conductive material while the interface portion 160 may be formed of aluminum and may have a thermally conductivity of approximately 160 W/m-K. Higher or lower values may be possible depending on the material. Alternatively, in other embodiments, the housing 110 and the interface portion 160 may be formed of the same material, e.g., a high thermal conductive material such as aluminum.

As shown in FIG. 3, the interface portion 160 may be formed of a rectangular shape and is attached to the housing 110 via an attaching means, e.g., screws or any other type of attaching means suitable for the purpose set forth herein. The present invention is not limited to using a single interface portion and may vary as necessary.

Figure 4:
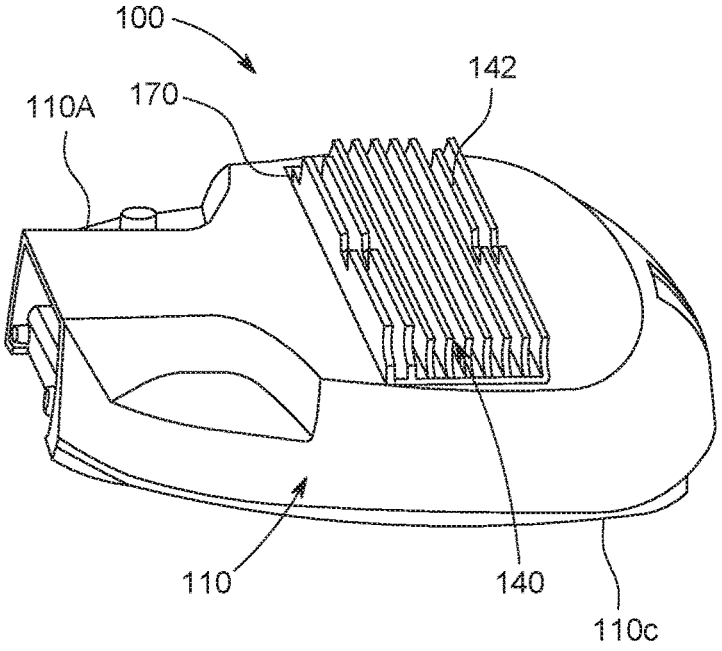
FIG. 4 is a schematic illustration of the modular heat management apparatus shown in FIG. 2, including an attachable heat sink mounted thereon according to one or more exemplary embodiments.

FIG. 4 is a schematic illustration of the modular heat management apparatus shown in FIG. 3, including the attachable heat sink 140 mounted thereon according to one or more exemplary embodiments.

As shown in FIG. 4, the attachable heat sink 140 is disposed on a top surface of the interface portion 160 such that it covers the entire top surface of the interface portion 160. The heat sink 140 is formed of a plurality of aligned fin portions (on the picture it is marked with 142) at one side surface thereof opposite the side surface which is mounted to the interface portion 160. The heat sink 140 is mounted and attached to the interface portion 160 using the fixing element 170, to firmly and securely keep the attachable heat sink 140 in place. The fixing element 170 may be a single element or comprise a plurality of fixing elements. The fixing element(s) 170 are configured to apply contact pressure to the heat sink 140 for securing the heat sink 140 to the interface portion 160. The thermal connection between the interface portion 160 and the heat sink 140 is realized by applying sufficient contact pressure using the fixing elements 170. As shown in graph 1000 in FIG. 10, the amount of the contact pressure $P_{contact}$ may be high enough e.g., approximately 0.35 Mpa, such that the thermal contact resistance $R_{contact}$ is negligible (e.g., approximately 0.0003 K-m$^2$/W, where K is degrees Kelvin).

Referring back to FIG. 4, the heat sink 140 may be formed of the same material as that of the interface portion 160. For example, the heat sink 140 may also be made of aluminum.

The lighting engine 113 and the PCB 114 including the lighting elements 115 and other electrical circuitry mounted thereon along with the lighting driver 125 in electrical communication with the lighting engine 113 which are mounted at an inner region 110*b* of the housing 110 (as depicted in FIG. 1), are opposite and adjacent to a position of the interface portion 160 disposed at the top surface 110*a* of the housing 110 and the heat sink 140 disposed thereon as shown in FIGS. 3 and 4. The fin portions 142 of the heat sink 140 assist with the dissipation of heat generated inside the housing 110 including but not limited to heat generated from the above-mentioned components. Although a single heat sink 140 is illustrated herein, the present invention is not limited to a particular number of heat sinks, and may vary as necessary. Further, the present invention is not limited to a particular type of heat sink 140 or fixing element 170, and therefore may vary accordingly. A modular heat management apparatus 100 according to other exemplary embodiments will now be described with reference to FIGS. 6 through 9B.

Figure 5:
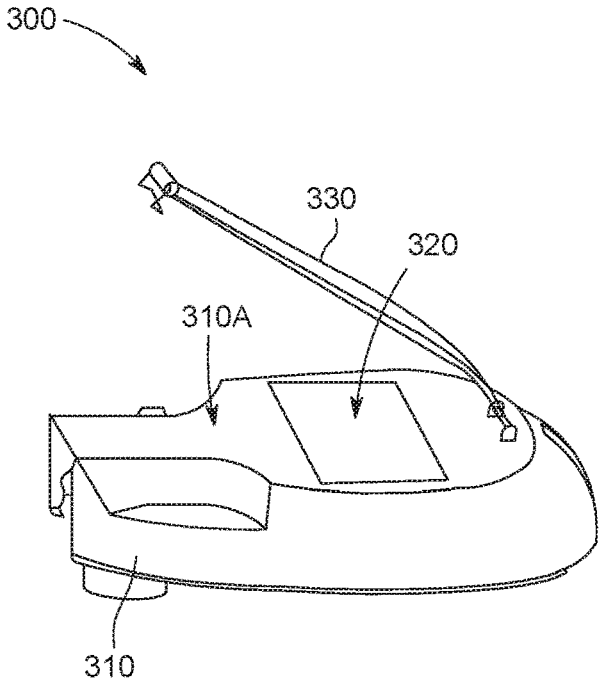
FIG. 5 is a schematic illustration of a modular heat management apparatus of an outdoor lighting system according to one or more alternative exemplary embodiments.

FIG. 5 is a schematic illustration of a modular heat management apparatus 300 of an outdoor lighting system 50 according to one or more alternative exemplary embodiments. As shown in FIG. 5, the modular heat management apparatus 300 includes components similar to those of the modular heat management apparatus 100 as shown and described in FIG. 3, therefore a detailed description of these elements is omitted. The modular heat management apparatus 300 includes a housing 310 including an interface portion 320, a fixing element 330 and a heat sink 340 (as depicted in FIG. 6).

According to one or more exemplary embodiments, the interface portion 320 may vary in size. The interface portion 320 is formed at a top surface 310*a* of the housing 310.

Figure 6:
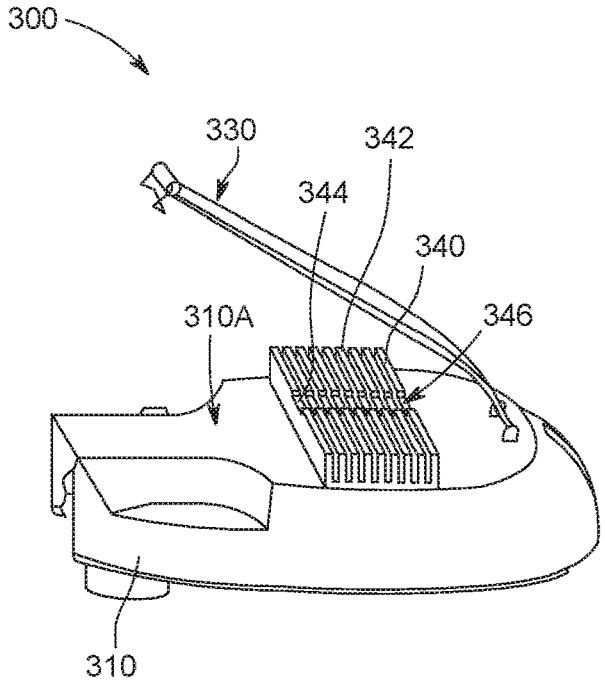
FIG. 6 is a schematic illustration of the modular heat management apparatus of FIG. 5 including the heat sink to be mounted thereon, according to one or more exemplary embodiments.

FIG. 6 is a schematic illustration of the modular heat management apparatus 300 of FIG. 5 including the heat sink 340 to be mounted thereon, according to one or more exemplary embodiments. As shown in FIG. 6, the heat sink 340 is mounted on the interface portion 320 and substantially completely covers the interface portion 320. The heat sink 340 comprises a receiving portion 346 for receiving the fixing element 330 therein. As shown, the heat sink 340 comprises a plurality of aligned fin portions 342, each fin portion 342 comprises a depression part 344 at a center region thereof, and the fin portions 342 are in parallel with each other, and in close proximity to thereby form the receiving portion 346 along the center region of the heat sink 340, for receiving the fixing element 330 therein.

Figure 8:
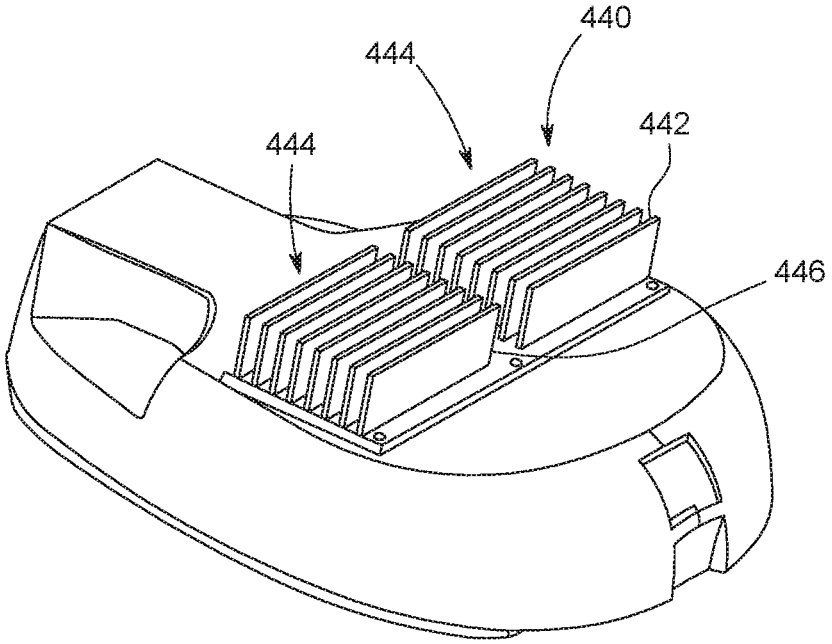
FIG. 8 is a schematic illustration of an attachable heat sink according to one or more alternative exemplary embodiments.

According to another exemplary embodiment as shown in FIG. 8, the heat sink 440 includes the fin portions 442 which do not include a depression part 344 and instead are shorter in length and aligned in at least two column sections 444 such that an opening 446 exists between the two column sections 444 for receiving the fixing element 330.

Figure 7:
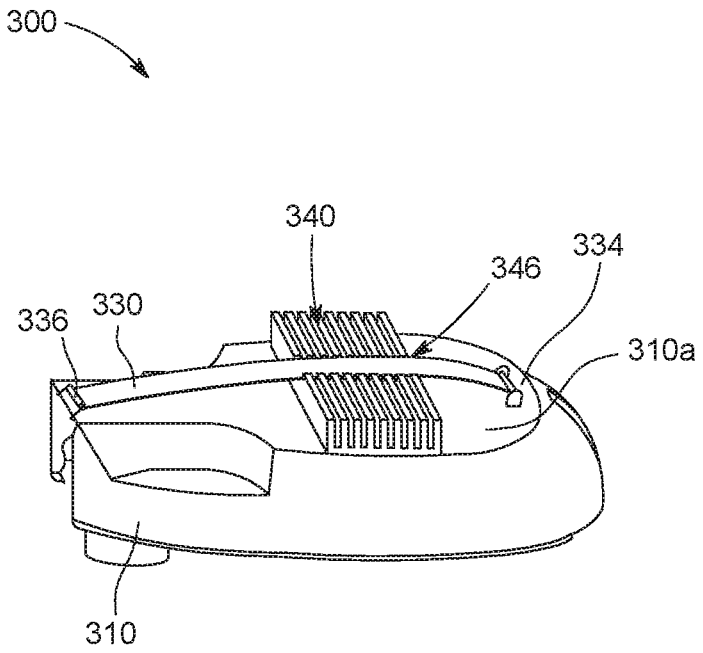
FIG. 7 is a schematic illustration of the modular heat management apparatus of FIG. 6 including a fixing element for fixing the heat sink, according to one or more exemplary embodiments.

Now referring back to FIG. 7, FIG. 7 is a schematic illustration of the modular heat management apparatus 300 of FIG. 6 showing the fixing element 330 for fixing the heat sink 340, according to one or more exemplary embodiments. As shown in FIG. 7, the fixing element 330 is formed of a flexible material in a strap form, and is attached to the top surface 310*a* of the housing 310 via first and second attaching means 334 and 336 at opposite ends of the top surface 310*a*. Additional details regarding the fixing element 330 will be discussed below with reference to FIGS. 9A and 9 B.

Figure 9A:
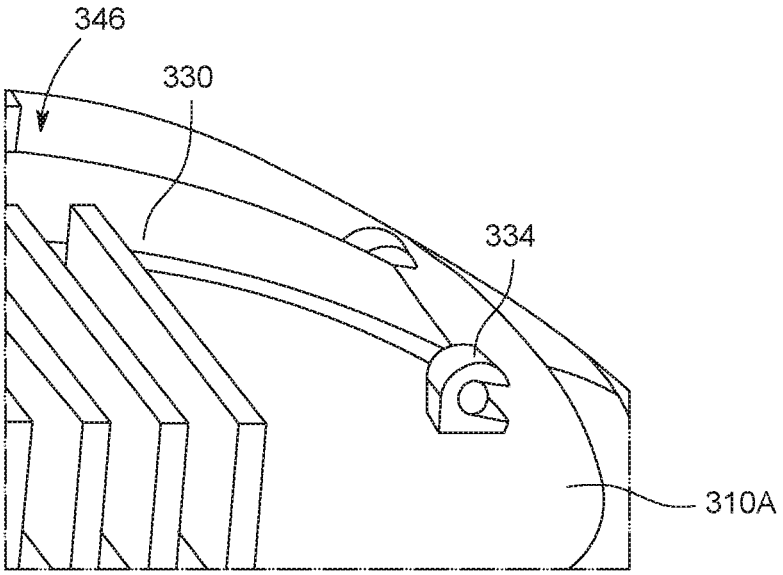
FIGS. 9A and 9B are schematic illustrations of the fixing element of FIG. 7 according to one or more exemplary embodiments.
Figure 9B:
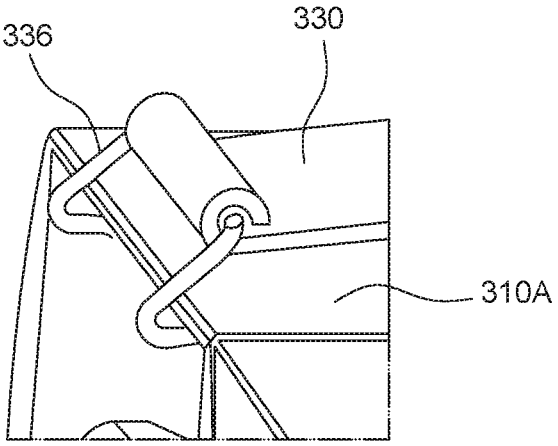
Figure 10:
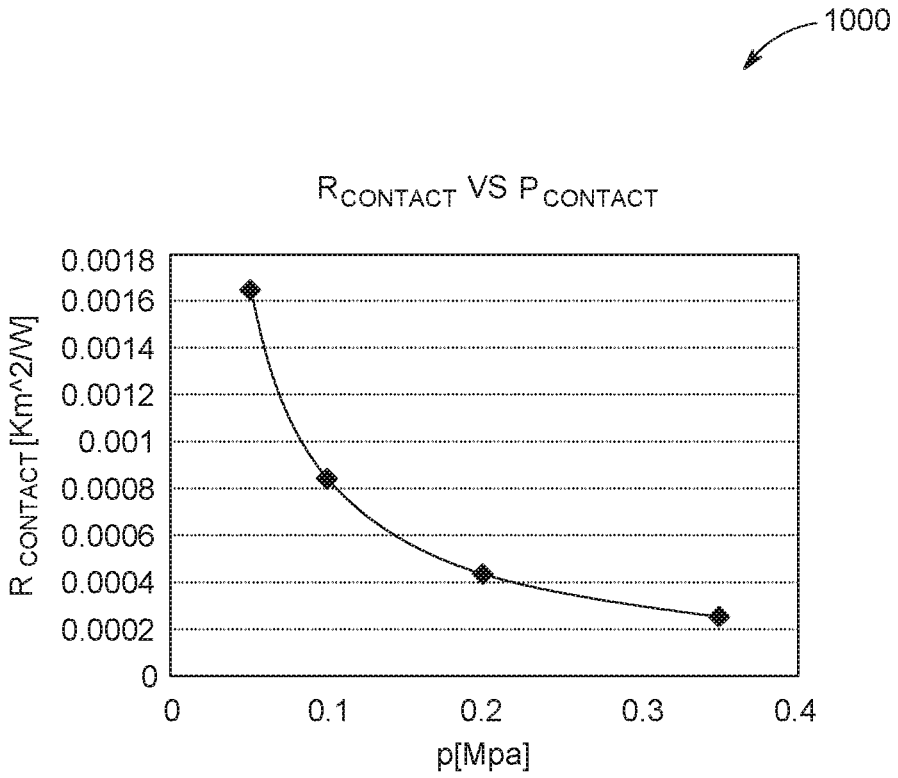
FIG. 10 is a graphical illustration of contact pressure applied by the fixing element against the contact thermal resistance of the interface portion, according to one or more exemplary embodiments.

FIGS. 9A and 9B are schematic illustrations of the fixing element of FIG. 7 according to one or more exemplary embodiments.

As shown in FIG. 9A, the fixing element 330 rests within a hook portion of the first attaching means 334 and is rotated about the first attaching means 334 at a first end of the top surface 310*a* of the housing 310, to bend within the receiving portion 346 and be housed therein, and to be connected to the second attaching means 336 at a second end opposite the first end as shown in FIG. 9B. The end of the fixing element 330 connecting with the second attaching means 336 includes a hook portion to hook and surround the second attaching means 336. When secured, the fixing element 330 applies contact pressure to the heat sink 340 for securely mounting the heat sink 340 to the interface portion 320.

Exemplary embodiments of the present invention, provide the advantage of heat management within an outdoor lighting system by employing an attachable heat sink, an interface portion and a fixing element for fixing the heat sink to the interface portion.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A modular heat management apparatus for an outdoor lighting system, the system including a plurality of lighting elements, the modular heat management apparatus comprising:

a housing comprising:

an interface portion disposed at a top surface of the housing;

an attachable heat sink to be disposed and mounted onto the interface portion, wherein the interface portion is formed of a thermal conductive material higher in thermal conductivity than that of the housing, and configured to dissipate heat generated by the outdoor lighting system; and a fixing element configured to attach the attachable heat sink to the interface portion and to apply contact pressure thereto.

2. The modular heat management apparatus of claim 1, further comprising:

a printed circuit board including the plurality of lighting elements mounted thereon, the printed circuit board mounted at an inner top surface of the housing opposite and adjacent to a position of the interface portion disposed at the top surface of the housing.

3. The modular heat management apparatus of claim 1, wherein the housing is formed of a high thermal conductive material.

4. The modular heat management apparatus of claim 1, wherein the thermal conductivity of the interface portion is approximately 160 W/m-K.

5. The modular heat management apparatus of claim 1, wherein the attachable heat sink substantially completely covers the interface portion and comprises a plurality of fin portions at one side surface thereof opposite a side surface which is mounted to the interface portion.

6. The modular heat management apparatus of claim 1, wherein the housing is formed of a low thermal conductive material.

7. The modular heat management apparatus of claim 6, wherein the low thermal conductive material comprises plastic, iron, or titanium.

8. The modular heat management apparatus of claim 1, wherein the fixing element comprises a plurality of fixing elements in physical contact with the attachable heat sink and configured to apply a contact pressure to the attachable heat sink for securing the heat sink to the interface portion.

9. The modular heat management apparatus of claim 8, wherein the contact pressure is approximately 0.35 MPa.

10. The modular heat management apparatus of claim 1, wherein the attachable heat sink and the interface portion are formed of a same material.

11. The modular heat management apparatus of claim 10, wherein the material comprises aluminum.

12. A modular heat management apparatus of an outdoor lighting system, the system including a plurality of lighting elements, the modular heat management apparatus comprising:

a housing comprising:

an interface portion disposed at a top surface of the housing, wherein the interface portion is formed of a thermal conductive material higher in thermal conductivity than that of the housing;

an attachable heat sink to be disposed on the interface portion and configured to dissipate heat generated by the outdoor lighting system, the attachable heat sink having a receiving portion for receiving a fixing element; and at least one fixing element configured to be disposed within the receiving portion, to attach the attachable heat sink to the interface portion, and to apply contact pressure thereto.

13. The modular heat management apparatus of claim 12, further comprising:

a printed circuit board including the plurality of lighting elements mounted thereon, the printed circuit board mounted at an inner top surface of the housing opposite and adjacent to a position of the interface portion disposed at the top surface of the housing.

14. The modular heat management apparatus of claim 12, wherein the housing is formed of a low thermal conductive material.

15. The modular heat management apparatus of claim 12, wherein the thermal conductivity of the interface portion is approximately 160 W/m-K.

16. The modular heat management apparatus of claim 12, wherein the attachable heat sink substantially completely covers the interface portion and comprises a plurality of fin portions, the plurality of fin portions comprising a depression part at a region thereof, the depression part forming the receiving portion of the attachable heat sink, for receiving the fixing element.

17. The modular heat management apparatus of claim 12, wherein the fixing element is disposed within the receiving portion and attached to the housing via a first attaching means at a first end of the top surface of the housing, and a second attaching means at a second end of the top surface of the housing.

18. The modular heat management apparatus of claim 12, wherein the attachable heat sink comprises a plurality of fin portions aligned in at least two column sections such that an opening exists between the two column sections, for receiving the fixing element.

19. The modular heat management apparatus of claim 12, wherein the housing is formed of a low thermal conductive material.

20. The modular heat management apparatus of claim 19, wherein the low thermal conductive material comprises plastic, iron, or titanium.

21. A modular heat management apparatus for a lighting system, the system including a plurality of lighting elements, the modular heat management apparatus comprising:

a housing comprising:

an interface portion disposed at a top surface of the housing, wherein the interface portion is formed of a thermal conductive material higher in thermal conductivity than that of the housing, an attachable heat sink to be disposed and mounted onto the interface portion and configured to dissipate heat generated by the outdoor lighting system; and a fixing element configured to attach the attachable heat sink to the interface portion and to apply contact pressure thereto.

* * * * *